US005358247A

United States Patent [19]

Meffert

[11] Patent Number: 5,358,247

[45] Date of Patent: Oct. 25, 1994

[54] PUZZLE BALL

[75] Inventor: Uwe Meffert, Ap Lei Chau, Hong Kong

[73] Assignee: I-Development Institute Ltd., Aberdeen, Hong Kong

[21] Appl. No.: 103,110

[22] Filed: Aug. 9, 1993

[30] Foreign Application Priority Data

Aug. 17, 1992 [GB] United Kingdom ..... 9217440.8
Aug. 18, 1992 [GB] United Kingdom ..... 9217559.5

[51] Int. Cl.[5] ..... A63F 9/06
[52] U.S. Cl. ..... 273/153 S
[58] Field of Search ..... 273/153 R, 153 S

[56] References Cited

U.S. PATENT DOCUMENTS 4,522,401 6/1985 Gustafson ..... 273/153 S
4,553,754 11/1985 Wiggs et al. ..... 273/153 S
4,557,484 12/1985 Sherman, Jr. et al. ..... 273/153 S
4,558,866 12/1985 Alford .
5,199,711 4/1993 Pataki et al. .

FOREIGN PATENT DOCUMENTS 1188342 6/1985 Canada ..... 273/153 S
0042695 12/1981 European Pat. Off. .
3116973 11/1982 Fed. Rep. of Germany ... 273/153 S
170062 12/1977 Hungary .
205017B 3/1992 Hungary .
WO83/01008 3/1983 PCT Int'l Appl. .
1391073 4/1988 U.S.S.R. ..... 273/153 S
8301203 4/1983 World Int. Prop. O. ..... 273/153 S
8703212 6/1987 World Int. Prop. O. ..... 273/153 S

OTHER PUBLICATIONS

"Puzzles" by Slorum & Botermans, 1986, Plenary Publications, International, pp. 138–139.

*Primary Examiner*—Vincent Millin
*Assistant Examiner*—Raleigh W. Chiu
*Attorney, Agent, or Firm*—Spencer, Frank & Schneider

[57] ABSTRACT

A spherical logical puzzle is disclosed comprising four interconnected branches, each of which defines a branch axis and comprises a fixed puzzle segment of arcuate triangular shape connected thereto, the segment being rotatable about its respective branch axis; a plurality of free puzzle segments are also provided comprising six arcuate square puzzle segments and four arcuate triangular puzzle segments, the free and fixed puzzle segments being coupled together to form a sphere; the segments are capable of adopting a plurality of positions relative to one another, and are movable between these positions by relative rotation of the segments in planes perpendicular to the branch axes.

15 Claims, 3 Drawing Sheets

PUZZLE BALL

CROSS REFERENCE TO RELATED APPLICATIONS

The present application claims the right of priority with respect to application serial number 9217440-8 filed on Aug. 17, 1992 and application serial number 9217559-5 filed on Aug. 18, 1992 in the United Kingdom.

BACKGROUND OF THE INVENTION

This invention relates to a puzzle.

Three dimensional logical puzzles which include a plurality of segments interlocked to form a cube or regular polyhedron have been proposed for example as disclosed in Hungarian Patent No. 170,062 to Rubik, or in U.S. Pat. No. 4,558,866 to Alford.

U.S. Pat. No. 4,558,866 also proposes a spherical puzzle design comprised of eighteen segments of at least three different shapes. Such a puzzle design has the disadvantage of being very difficult to manufacture.

SUMMARY OF THE INVENTION

It is an object of the invention to provide an improved spherical puzzle design.

It is a further object of the invention to provide a three dimensional logical puzzle with increase entertainment value.

According to a first embodiment of the present invention, there is provided a puzzle comprising:

four interconnected axis defining branches, each branch having a fixed puzzle segment of arcuate triangular shape connected thereto, the segments being rotatable about their respective branch axes; and a plurality of free puzzle segments comprising six arcuate square puzzle segments and four arcuate triangular puzzle segments, the free and fixed puzzle segments being coupled together to form a sphere, the segments being capable of adopting a plurality of positions relative to one another and being movable between these positions by the relative rotation of the segments in planes perpendicular to the branch axes.

In contrast to all existing rotating puzzles, the present invention contemplates a puzzle which always involves the relative rotation of two complete half spheres. There are eight different half spheres for the four rotating axes.

According to a second embodiment of the present invention, there is provided a three dimensional puzzle comprising a plurality of segments which together form a regular shape such as a sphere, the segments being movable relative to one another, and wherein a three dimensional representation is provided on a group of the segments in a given orientation of the segments relative to one another. The three dimensional representation is preferably a representation of a cartoon character, and is provided in raised relief on the segments. Further three dimensional representations may be applied to other groups of segments of the puzzle. If the puzzle is a polyhedron, the group of segments preferably form at least part of one side of the polyhedron in a given orientation of the segments relative to one another.

If the puzzle is spherical, and more particularly of the kind envisaged in the first embodiment of the present invention, each representation is preferably applied to one arcuate square segment and four adjacent arcuate triangular segments, or, alternatively, to two adjacent arcuate square segments and two interposed arcuate triangular segments.

BRIEF DESCRIPTION OF THE DRAWINGS

An embodiment of the invention will now be described, by way of example, with reference to the accompanying drawings, in which.

DETAILED DESCRIPTION OF THE INVENTION

Figure 1:
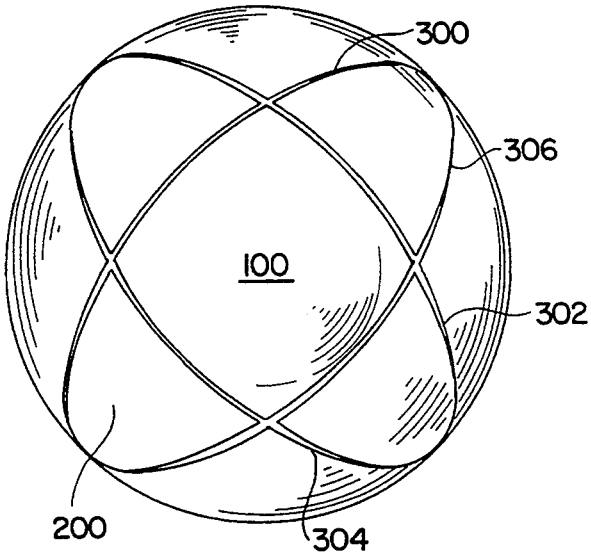
FIG. 1 is a perspective view of an embodiment of the invention.

FIG. 1 shows an embodiment of the invention in the form of a spherical logical puzzle. The puzzle is divided up into a plurality of arcuate segments, including six arcuate square segments, such as segment 100, and eight arcuate triangular segments, such as segment 200. The segments are rotatable relative to one another about axes perpendicular to the four non-orthogonal planes 300, 302, 304 and 306. The puzzle is capable of adopting a plurality of orientations, although it is only rotatable about axes perpendicular to planes 300, 302, 304, and 306 when a regular orientation is adopted of the form shown in FIG. 1, where the planes are continuously defined by the sides of the segments. Rotation about any one of the axes allows the relative position of the segments to be changed in a multitude of different ways, and, as the puzzle is circular, identification of any particular segment is far more difficult than, for example, on a polyhedral puzzle.

The mechanism of the puzzle is shown in more detail in FIGS. 2–5.

Figure 2:
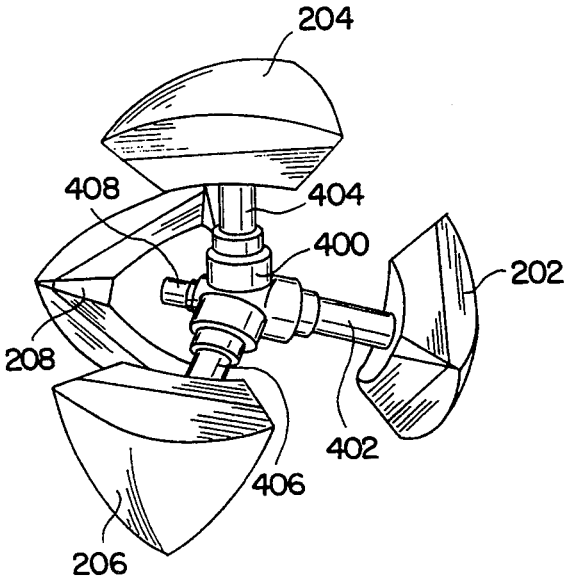
FIG. 2 is a perspective view of four fixed segments and supporting structure of the embodiment of FIG. 1.

With reference to FIG. 2, the central support structure of the puzzle is shown. This central support structure comprises a central boss 400 to which four branches 402, 404, 406, and 408 are connected in such a way that each branch forms the same angle (i.e.: an angle equal to arccos $(-\frac{1}{3})$) with respect to every other branch. Fixed arcuate triangular segments 202, 204, 206, and 208 are connected, respectively, to each of the branches 402, 404, 406, and 408. The joint between each branch and boss 400 allows rotation of the branch relative to the boss about the longitudinal axis of the branch.

Figure 3:
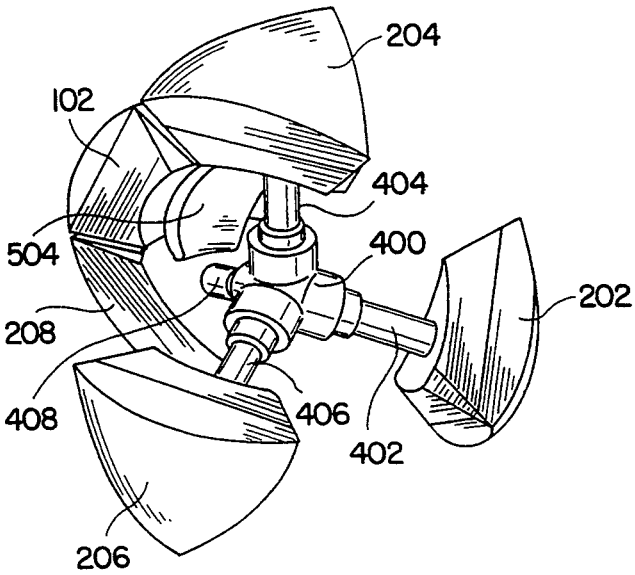
FIG. 3 is a view similar to FIG. 2, but showing the addition of a free segment.
Figure 4:
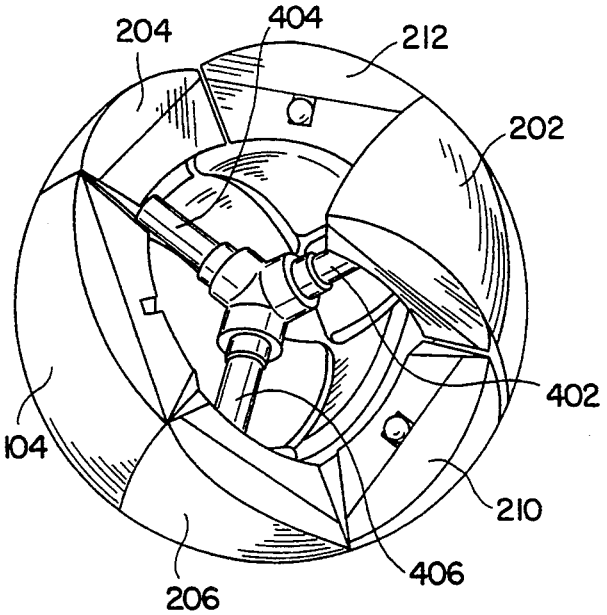
FIG. 4 is a view similar to FIG. 1, with some of the segments having been removed.

Between the four fixed segments, a plurality of free segments is disposed, the free segments comprising six arcuate square segments which fit between adjacent fixed triangular segments 202, 204, 206, and 208 as shown, for example in FIG. 3, in which arcuate square segment 102 is fitted between fixed segments 204 and 208, and in FIG. 4, in which segment 104 is fitted between segments 204 and 206. Four free arcuate triangular segments such as, for example, segments 210 and 212 in FIG. 4, are further provided which are fitted between the square segments at the positions unoccupied by the fixed triangular segments 202, 204, 206, and 208. The sides of the segments all have the same length and arcuate shape. Together, the segments form the sphere shown in FIG. 1.

The triangular segments of the puzzle have a special relationship, in that the four fixed triangular segments together define the corners of a tetrahedron and remain in such fixed relative positions. Similarly, the four floating triangular segments also form the corners of another fixed tetrahedron. Although the segments may be rotated as a result of movement of the puzzle, the set of four fixed triangular segments and the set of four floating triangular segments always retain their relative positions.

Figure 5:
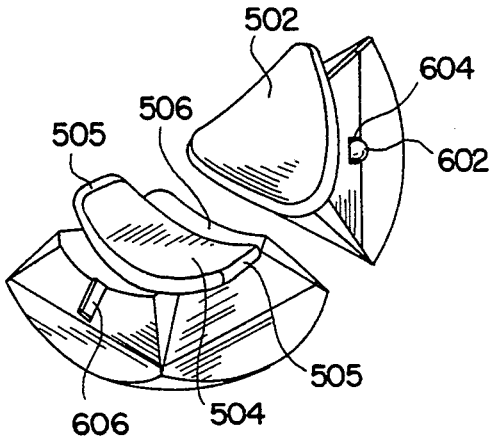
FIG. 5 illustrates an arcuate triangular segment and an arcuate square segment of the embodiment of FIG. 1.

The free segments are each provided with a lip member as shown in FIG. 5 to couple the segments together, the free triangular segments being provided with a triangular shaped lip member 502, and the free square segments being provided with a substantially oblong lip 504, both lip members being arcuate. The rectangular shaped lip members of the square segments, when the segments are assembled, extend towards the branches of the fixed elements as shown in FIG. 3 in order to provide an overlap between the square segments and the adjacent fixed triangular segments when the puzzle is in a regular orientation as defined above.

Ledges 506 on either side of the lip member 504 allow projecting ends of other lip members 504 and the projecting sides of lip members 502 to engage the arcuate square segments while allowing relative rotation in the regular orientations of the puzzle. Provided the puzzle is arranged in a regular orientation such as that shown in FIG. 1, the puzzle will be able to rotate about any of the four rotational axes, with the lip members holding the puzzle together.

In order to align the segments at the orientations which allow relative rotation of the segments of the puzzle in the non-orthorgonal planes, a click/stop mechanism is provided for locating the arcuate square segments relative to the free arcuate triangular segments. In this respect, each face of the arcuate triangular segments is provided with a captured ball bearing 602 which is urged to partially protrude through opening 604 by a spring (not shown). Each arcuate square segment 100 is provided with a location slot 606 on its two faces opposite those over which the tongues 505 of lip member 504 extend. The ball bearings 602 engage in the slots 606 in a click/stop manner at those orientations which allow rotation about any one of the four axes. Other redundant positions are also engaged by this mechanism, but they can easily be ignored, as the puzzle will not rotate upon any other axis but the one about which it has been rotated to arrive at that position.

Figure 6:
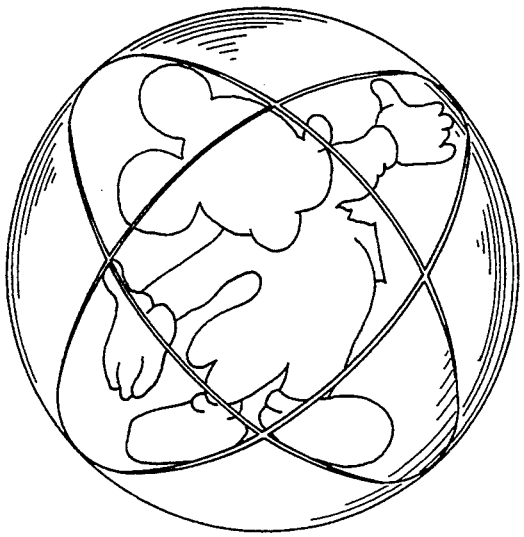
FIG. 6 is a view similar to FIG. 1, but showing the puzzle as having been provided with a representation formed on five of its segments.
Figure 7:
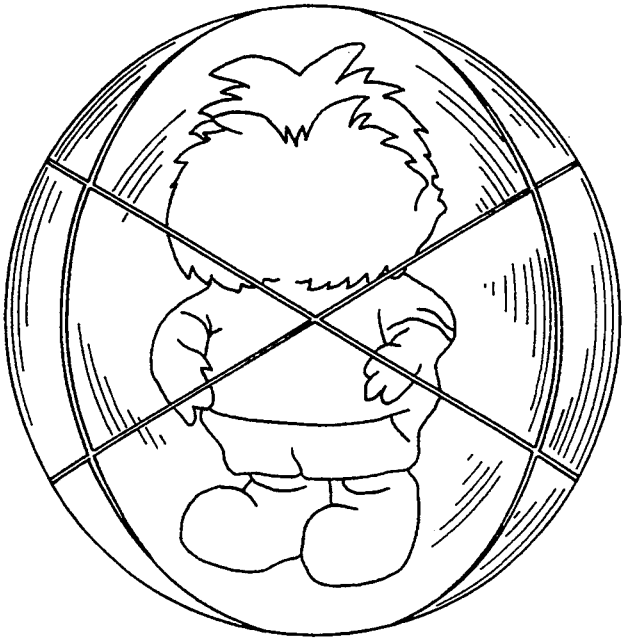
FIG. 7 is a view similar to FIG. 1, but showing a representation applied to four adjacent segments.
Figure 8:
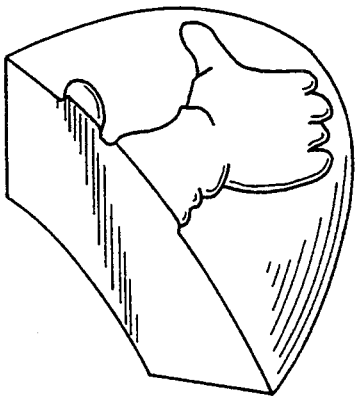
FIG. 8 is a perspective of one puzzle segment illustrating the raised relief representation.

In use, the puzzle is preferably marked with a predetermined pattern or shading so that a single relative orientation of the various segments is defined. For example, one half of the puzzle to one side of one of the rotation planes may be colored red and the other blue. However, in the preferred embodiment of the invention, a representation, for example a cartoon figure is formed on several of the segments. Two embodiments depicting the above are shown in FIGS. 6 and 7. In FIG. 6, the representation is provided on one arcuate square segment and four adjacent arcuate triangular segments. In FIG. 7 the representation is provided on two arcuate square segments and the two interposing arcuate triangular segments. Furthermore, in order to make the puzzle more complicated, a further representation may be applied on the reverse side of the puzzle to corresponding segments.

In an alternative embodiment of the present invention, the representation, for example as shown in FIGS. 6 and 7, is not formed as a two dimensional image, but rather as a three dimensional sculpture raised from the surface of the puzzle. In addition to providing the puzzle with a novel and eye catching look, the three dimensional representation gives the puzzle a raised outline which can be felt by the user. This allows the puzzle to have applications for use by the partially sighted who will be able to solve the puzzle by touch instead of by sight. Furthermore, providing such a raised representation enables a sighted player to be able to "view" the puzzle in a completely new way, both by sight and by touch. In this respect, in an orientation in which the segments of the representation are not complete, the user will be able to see the partially completed representation in front of him but will also be able to feel the whereabouts of the missing pieces on the "dark side" of the puzzle.

Although the puzzle has been described with four and five segments covered by the representation, this is not construed as limitative, and any number of segments may include portions of the representation. Furthermore, the use of a three dimensional representation on the surface of a spherical puzzle is not to be construed as limitative and is applicable for use with other forms of rotating puzzle, for example on puzzles of any polyhedral form.

It will be understood that the above description of the present invention is susceptible to various modifications, changes and adaptations, and the same are intended to be comprehended within the meaning and range of equivalents of the appended claims.

What is claimed is:

1. A puzzle comprising:

four interconnected branches, each of said branches defining a branch axis and having a fixed puzzle segment of arcuate triangular shape connected thereto, said fixed puzzle segment being rotatable about a respective branch axis thereof; and a plurality of free puzzle segments comprising six arcuate square puzzle segments and four arcuate triangular puzzle segments, said fixed and free puzzle segments being coupled together to form a sphere, said segments further being capable of adopting a plurality of positions relative to one another and being movable between said positions by relative rotation of the segments in planes perpendicular to said branch axes.

2. The puzzle according to claim 1, wherein said branches are rotatably connected to a boss centrally disposed within said puzzle, the branches being rotatable relative to their respective branch axes.

3. The puzzle according to claim 1, wherein said segments have sides which are of the same length.

4. The puzzle according to claim 1, wherein a plurality of said segments are provided with lip means, each of said lip means being effective for engaging sections of segments adjacent thereto in order to hold the puzzle together.

5. The puzzle according to claim 1, wherein a plurality of said segments are provided with click/stop means for aligning the segments in an orientation allowing their relative rotation in planes perpendicular to the branch axes.

6. The puzzle according to claim 1, wherein a representation is provided on at least two segments aligned in a given orientation relative to one another.

7. The puzzle according to claim 6, wherein the representation is provided on one arcuate square segment and four adjacent arcuate triangular segments.

8. The puzzle according to claim 6, wherein the representation is provided on two adjacent arcuate square segments and two interposed arcuate triangular segments.

9. The puzzle according to claim 6, wherein said representation is three dimensional.

10. The puzzle according to claim 9, wherein the representation is formed as a raised relief on said segments.

11. A three dimensional puzzle consisting of six arcuate square segments and eight arcuate triangular segments together forming a sphere, the segments being movable relative to one another, and a first three dimensional representation is provided on a first group of segments aligned in a given orientation relative to one another.

12. The puzzle according to claim 9, wherein the three dimensional representation is a representation of a cartoon character.

13. The puzzle according to claim 12, wherein the representation is formed as a raised relief on said at least two segments.

14. The puzzle according to claim 1, wherein the puzzle is a polyhedron.

15. The puzzle according to claim 9, said puzzle further comprising a second three dimensional representation provided on a second group of segments of said puzzle.

* * * * *